United States Patent [19]

Sano et al.

[11] Patent Number: 4,999,543

[45] Date of Patent: Mar. 12, 1991

[54] BRILLIANCE CONTROL CIRCUIT FOR CONTROLLING THE BRILLIANCE OF FLUORESCENT DISPLAY TUBES

[75] Inventors: Masanori Sano; Masanori Ueyama; Kenji Watanabe, all of Nara, Japan

[73] Assignee: Sharp Kabushiki Kaisha, Osaka, Japan

[21] Appl. No.: 236,991

[22] Filed: Aug. 26, 1988

[30] Foreign Application Priority Data

Aug. 27, 1988 [JP] Japan ..... 62-130382[U]

[51] Int. Cl.[5] ..... G09G 3/10

[52] U.S. Cl. ..... 315/169.3; 315/260; 315/334; 315/291

[58] Field of Search ..... 315/291, 307, 169.3, 315/169.1, 260; 51/334

[56] References Cited

U.S. PATENT DOCUMENTS

| | | | |
|---|---|---|---|
| 335,060 | 1/1986 | Doubleday | 315/291 |
| 2,254,957 | 9/1941 | Bay et al. | 315/169.3 |
| 2,897,405 | 7/1959 | Briggs et al. | 315/169.3 |
| 3,050,654 | 8/1962 | Toulon | 315/169.3 |
| 3,157,822 | 11/1964 | Haskell | 315/169.3 |
| 3,247,390 | 4/1966 | Kazan | 315/169.3 |
| 4,135,117 | 1/1979 | DuBois | 315/169.1 |
| 4,450,385 | 5/1984 | Buhrer | 315/208 |
| 4,587,462 | 5/1986 | Buhrer | 315/260 |
| 4,633,141 | 12/1986 | Weber | 315/307 |
| 4,691,145 | 9/1987 | Satoh | 315/169.1 |

OTHER PUBLICATIONS

Hayt et al, "Engineering Circuit Analysis", Third Edition, 1978, p. 54.

*Primary Examiner*—Eugene R. LaRoche
*Assistant Examiner*—Michael B. Shingleton

[57] ABSTRACT

A brilliance control circuit capable of automatically controlling the brilliance of fluorescent display tubes, comprising a lighting voltage regulating circuit incorporating a circuit element which decreases the lighting voltage when the current flowing through the fluorescent display tube increases, and increases the lighting voltage when the current decreases.

6 Claims, 2 Drawing Sheets

BRILLIANCE CONTROL CIRCUIT FOR CONTROLLING THE BRILLIANCE OF FLUORESCENT DISPLAY TUBES

BACKGROUND OF THE INVENTION

The present invention relates to a brilliance control circuit for automatically controlling the brilliance of fluorescent display tubes.

As shown in FIGS. 3 and 4, the conventional fluorescent display tube lighting circuit employs a Zener diode ZD1 to maintain the lighting voltage on a fixed level. FIG. 5 is a waveform chart of grid voltage regulated by a circuit shown in FIG. 3, and FIG. 6 is a waveform chart of grid voltage regulated by a circuit shown in FIG. 4.

However, when such a conventional lighting circuit is used in combination with a plurality of fluorescent display tubes, the respective inherent brilliances of the fluorescent display tubes are different from each other. Accordingly, when a plurality of fluorescent display tubes are used in combination to display a numerical value of a plurality of digits, the digits are different from each other in brilliance, which makes reading the numerical value very difficult.

SUMMARY OF THE INVENTION

Accordingly, it is an object of the present invention to provide a brilliance control circuit for fluorescent display tubes, capable of automatically controlling the brilliance of a plurality of fluorescent display tubes on a fixed level to reduce the difference between the fluorescent display tubes in brilliance.

Briefly described, in accordance with the present invention, a brilliance control circuit capable of, automatically controlling the brilliance of fluorescent display tubes comprises a lighting voltage regulating circuit incorporating a circuit element which decrease the lighting voltage of the fluorescent display tubes when the current flowing through the fluorescent display tubes increases, and increase the lighting voltage when the current decreases.

BRIEF DESCRIPTION OF THE DRAWINGS

The present invention will become more fully understood from the detailed description give hereunder and the accompanying drawings which are given by way of illustration only, and thus are not limitative of the present invention and wherein.

DESCRIPTION OF THE PREFERRED EMBODIMENT

Figure 1:
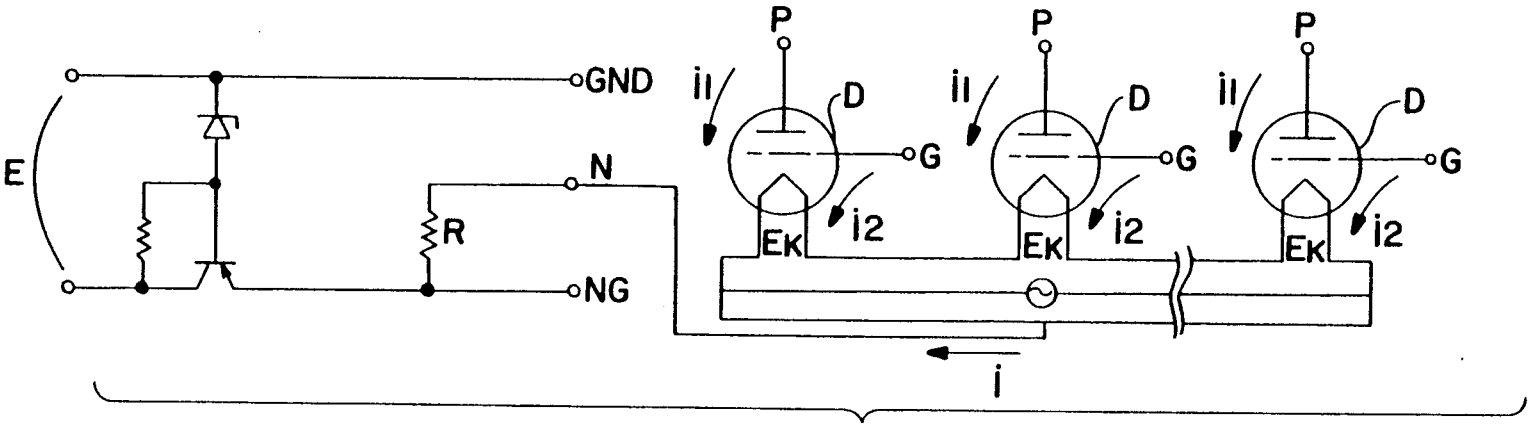
FIG. 1 is a circuit diagram of a brilliance control circuit for fluorescent display tubes, in a preferred embodiment, according to the present invention.
Figure 3:
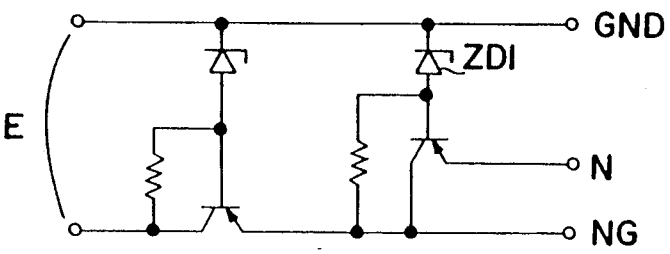
FIG. 3 PRIOR ART
FIGS. 3 and 4 are circuit diagrams of conventional brilliance control circuits.

Referring to FIG. 1 showing a brilliance control circuit for controlling the brilliance of fluorescent display tubes, there are shown an input power supply E, a ground level terminal GND, a lighting voltage terminal N, a resistor R, fluorescent display tubes D, plates P, grids G and cathode $E_k$. The lighting voltage VN is dependent on the voltage drop across the resistor R. Since the brilliance of the fluorescent display tube is proportional to the product of voltage and current, namely, power, current i increases when the brilliance is high, and current i decreases when the brilliance is low. Accordingly, when the brilliance is high, current increases and the voltage drop across the resistor R increases accordingly. Consequently, voltage at the lighting voltage terminal N decreases and the brilliance diminishes. On the contrary, when the brilliance is low, current i decreases and thereby the voltage drop across the resistor R decreases accordingly. Consequently, the voltage at the lighting voltage terminal N increases substantially, and thereby the brilliance is enhanced. Thus, the brilliance of the fluorescent display tube is maintained automatically on a fixed level.

Incidentally, since the automatically controlled brilliance is dependent on the resistance of the resistor R, the same brilliance is determined for all the fluorescent display tubes when the same resistor is used for all the fluorescent display tubes.

The use of a variable resistor instead of the resistor R enables setting an optional brilliance. Therefore, when a plurality of fluorescent display tubes are used in combination to form a multiple-digit display device, the use of a variable resistor enables the fine adjustment of the brilliance to eliminate the minute difference in brilliance between the digits in addition to automatically controlling the brilliance on a fixed level.

Figure 2:
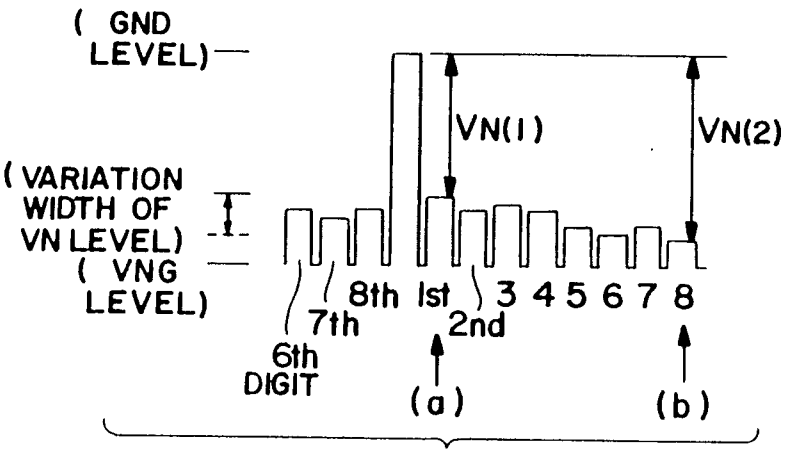
FIG. 2 is a waveform chart of the grid voltage of fluorescent display tubes controlled by the brilliance control circuit of FIG. 1.
Figure 4:
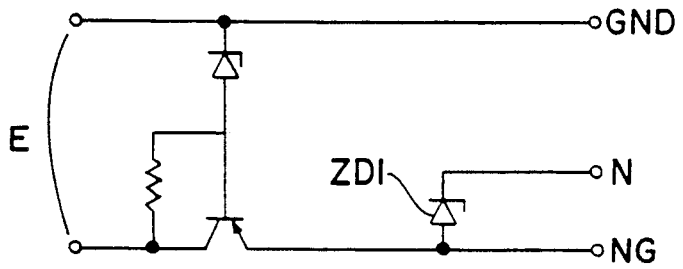
PRIOR ART FIG. 4
Figure 5:
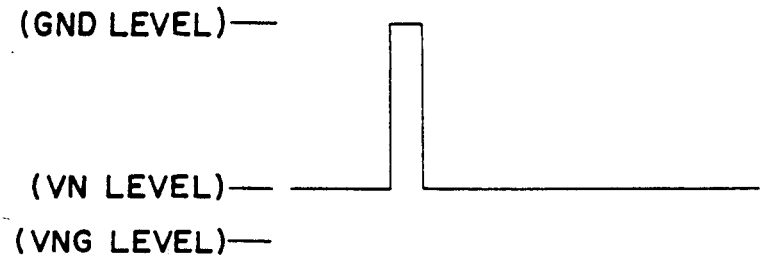
FIG. 5 is a waveform chart of the grid voltage of fluorescent display tubes controlled by the brilliance control circuit of FIG. 3.
Figure 6:
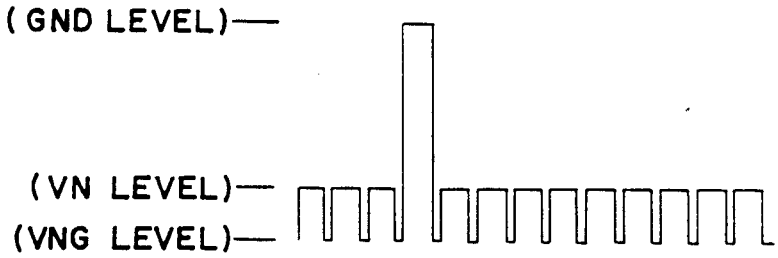
FIG. 6 is a waveform chart of the grid voltage of fluorescent display tubes controlled by the brilliance control circuit of FIG. 4.

FIG. 2 shows a waveform of the grid voltages of eight fluorescent display tubes forming an eight-digit display device, by way of example, for displaying eight digits. In FIG. 2, indicated at VN is a lighting voltage level,.and at VNG is an extinguishing voltage level. The lighting voltage level VN(1) of the fluorescent display tube for a bright digit (a) is lower while the lighting voltage level VN(2) of the fluorescent display tube for a dark digit (b) is higher. Thus, the fluorescent display tubes are substantially the same in brilliance and the difference in brilliance between the fluorescent display tubes is small. Thus, the brilliance control circuit is able to control the brilliance of the fluorescent display tubes automatically on a fixed level.

As is apparent from the foregoing description, the brilliance control circuit for fluorescent display tubes, according to the present invention comprises a lighting voltage regulating circuit incorporating a circuit element which decreases the lighting voltage of the fluorescent display tube when the current flowing through the fluorescent display tube increases, and increases the lighting voltage when the current decreases, for brilliance control. Accordingly, the brilliance of the fluorescent display tubes is controlled automatically to a fixed level, and hence a multiple-digit fluorescent display device consisting of a plurality of fluorescent display tubes controlled by the brilliance control circuit of the present invention is uniform in brilliance of the digits.

While only a certain embodiment of the present invention has been described, it will be apparent to those skilled in the art that various changes and modifications may be made therein without departing from the spirit and scope of the present invention as claimed.

What is claimed is:

1. A circuit for driving at least one fluorescent display tube having a cathode and a grid, comprising:

a grid voltage connected to said grid; and means for controlling the brilliance of said at least one display tube to maintain said brilliance constant, said means for controlling including, a resistor connected between an input power supply and said cathode, said resistor compensating for variations in current from said cathode to maintain the brilliance of said at least one tube relatively constant.

2. The circuit of claim 1 further comprising a cathode supply for supplying an alternating current to said cathode.

3. The circuit of claim 2, wherein said circuit drives at least two said display tubes, said grid voltage being connected to the grid of each said display tube, and said cathode supply supplying each said cathode.

4. The circuit of claim 1, wherein said means for controlling consists essentially of said resistor.

5. The circuit of claim 3, wherein said resistor is a variable resistor, said variable resistor allowing control of the brilliance of said at least two said display tubes.

6. The circuit of claim 1, wherein said resistor decreases a lighting voltage of said at least one tube when the current flowing through the tube increases, and said resistor increases a lighting voltage of said at least one tube when the current flowing through the tube decreases.

* * * * *